US009812786B2

(12) United States Patent
Foo

(10) Patent No.: US 9,812,786 B2
(45) Date of Patent: Nov. 7, 2017

(54) METAMATERIAL-BASED TRANSMITARRAY FOR MULTI-BEAM ANTENNA ARRAY ASSEMBLIES

(71) Applicant: Senglee Foo, Kanata (CA)

(72) Inventor: Senglee Foo, Kanata (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 14 days.

(21) Appl. No.: 15/134,751

(22) Filed: Apr. 21, 2016

(65) Prior Publication Data

US 2017/0062945 A1 Mar. 2, 2017

Related U.S. Application Data

(60) Provisional application No. 62/209,655, filed on Aug. 25, 2015.

(51) Int. Cl.

| | |
|---|---|
| ***H01Q 15/10*** | (2006.01) |
| ***H01Q 21/06*** | (2006.01) |
| *H01Q 25/00* | (2006.01) |

(52) U.S. Cl.

CPC ..... *H01Q 15/10* (2013.01); *H01Q 21/065* (2013.01); *H01Q 25/00* (2013.01)

(58) Field of Classification Search

CPC ..... H01Q 15/10; H01Q 21/065
USPC ..... 343/753
See application file for complete search history.

(56) References Cited

U.S. PATENT DOCUMENTS

| | | | | |
|---|---|---|---|---|
| 3,961,333 | A | 6/1976 | Purinton | |
| 7,154,451 | B1 * | 12/2006 | Sievenpiper | H01Q 1/248 343/753 |
| 7,245,269 | B2 * | 7/2007 | Sievenpiper | H01Q 19/104 343/700 MS |
| 7,456,803 | B1 * | 11/2008 | Sievenpiper | H01Q 15/02 343/700 MS |
| 8,451,189 | B1 * | 5/2013 | Fluhler | H01Q 15/0086 343/756 |
| 9,318,811 | B1 * | 4/2016 | Fluhler | H01Q 21/26 |
| 2010/0283698 | A1 | 11/2010 | Orihara | |

(Continued)

FOREIGN PATENT DOCUMENTS

| | | | |
|---|---|---|---|
| CN | 101836330 | A | 9/2010 |
| CN | 102349192 | A | 2/2012 |
| WO | 2004015809 | A2 | 2/2004 |

OTHER PUBLICATIONS

Al-Joumayly, Mudar A., et al., "A Generalized Method for Synthesizing Low-Profile, Band-Pass Frequency Selective Surfaces with Non-Resonant Constituting Elements," IEEE Transactions on Antennas and Propagation, vol. 58, No. 12, pp. 4033-4041, 2010.

(Continued)

*Primary Examiner* — Huedung Mancuso
(74) *Attorney, Agent, or Firm* — Gowling WLG (Canada) LLP

(57) ABSTRACT

A transmitarray, or radio frequency lens, can provide a large variation of time-delay. The transmitarray comprises a number of time-delay unit (TDU) cells that each have a capacitive patch and a rectangular wire loop separated by dielectric material. The rectangular wire loop allows current continuity to be maintained between adjacent TDU cells, even when different sized TDUs are included in the transmitarray.

18 Claims, 19 Drawing Sheets

(56) References Cited

U.S. PATENT DOCUMENTS

2012/0007786 A1 1/2012 Ando et al.

OTHER PUBLICATIONS

Li, Meng, et al., "Wideband True-Time-Delay Microwave Lenses Based on Metallo-Dielectric and All-Dielectric Lowpass Frequency Selective Surfaces," IEEE Transactions on Antennas and Propagation, vol. 61, No. 8, pp. 4109-4119, 2013.
Li, Meng, et al., "Broadband True-Time-Delay Microwave Lenses Based on Miniaturized Element Frequency Selective Surfaces," IEEE Transactions on Antennas and Propagation, vol. 61, No. 3, pp. 1166-1179, 2013.
International Search Report of International Patent Application No. PCT/CN2016/090201 dated Oct. 9, 2016.

* cited by examiner

METAMATERIAL-BASED TRANSMITARRAY FOR MULTI-BEAM ANTENNA ARRAY ASSEMBLIES

TECHNICAL FIELD

The current disclosure relates to antenna arrays for communication networks, and in particular to metamaterial-based lenses, or transmitarrays, for antenna arrays used in multi-beam communication environments.

BACKGROUND

Multi-beam antenna arrays are generally implemented using active or passive antenna array architectures. An active multi-beam array requires development of high-power transmit/receive modules that require complex high-speed digital processing. Passive large-aperture phased arrays generally suffer from excessive losses in complex beam forming networks.

An alternative multi-beam antenna array makes use of a dielectric microwave lens fed by spatially distributed feed antennas. However, use of such a dielectric microwave lens may suffer from significant losses caused by impedance mismatches between the lens aperture and feed antenna. Furthermore, lenses operating at low microwave frequencies are generally bulky, heavy and expensive to manufacture. In the past decades, several types of planar microwave lenses have been proposed using antenna elements connected using phase shifting devices. However, these methods generally suffer from poor scanning performance. Furthermore, these antennas typically require a large spacing between the feed antennas and the lens aperture, which increases an antenna's profile significantly.

An additional, alternative and/or improved multi-beam antenna array assembly is desirable.

SUMMARY

In accordance with the present disclosure there is provided a metamaterial lens for a radio frequency (RF) antenna comprising a plurality of adjacent time-delay unit (TDU) cells, each TDU cell comprising: a dielectric material; an inductive rectangular wire loop on a first side of the dielectric material arranged about a perimeter of the TDU cell; and a capacitive patch on a second side of the dielectric material and positioned within the perimeter of the TDU cell.

In a further embodiment of the metamaterial lens, the plurality of TDU cells comprise a plurality of subsets of TDU cells, wherein the TDU cells of different subsets are of different sizes and the TDU cells within the same subset are of the same size.

In a further embodiment of the metamaterial lens, a plurality of subsets of the plurality of different-sized TDU cells are arranged into a plurality of zones grouping together subsets of TDU cells of the same size with a smallest TDU cell located at an interior first zone with increasingly sized TDU cells surrounding zones of smaller sized TDU cells.

In a further embodiment of the metamaterial lens, TDU cells within the same subset of TDU cells have different sizes of capacitive patches.

In a further embodiment of the metamaterial lens, the inductive rectangular wire loops of the plurality of TDU cells are in contact with the inductive rectangular wire loops of adjacent TDU cells.

In a further embodiment of the metamaterial lens, wherein at least one of the plurality of TDU cells includes an inductive wire cross within the inductive wire loop.

In a further embodiment of the metamaterial lens, the capacitive patches of at least a subset of the TDU cells have different patch sizes.

In a further embodiment of the metamaterial lens, one or more of the capacitive patches of the plurality of TDU cells have an inductive cut-out.

In a further embodiment of the metamaterial lens, each of the plurality of TDU cells comprises one or more additional layers of inductive rectangular wire loops located along the perimeter of the TDU cell.

In a further embodiment of the metamaterial lens, each of the plurality of TDU cells comprises a plurality of layers of capacitive patches.

In a further embodiment of the metamaterial lens, each of the TDU cells comprises a plurality of layers of inductive rectangular wire loops located along a perimeter of the TDU cell and a plurality of layers of capacitive patches, each of the layers separated by a dielectric material.

In accordance with the present disclosure there is further provided an antenna array assembly comprising: a transmitarray having a focal distance, the transmitarray having a plurality of adjacent time-delay unit (TDU) cells, each TDU cell having an inductive rectangular wire loop located along a perimeter of the TDU cell, a capacitive patch, and a dielectric material separating the inductive rectangular wire loop and the capacitive patch; and a plurality of radiating elements arranged at a focal plane located the focal distance from the transmit array.

In a further embodiment of the antenna array, the plurality of TDU cells comprise a plurality of subsets of TDU cells with the TDU cells of different subsets are of different sizes, while TDU cells within the same subset are of the same size.

In a further embodiment of the antenna array, the subsets of the plurality of different-sized TDU cells are arranged into a plurality of zones grouping together subsets of TDU cells of the same size with a smallest TDU cell located at an interior first zone with increasingly sized TDU cells surrounding zones of smaller sized TDU cells.

In a further embodiment of the antenna array, TDU cells within respective ones of the plurality of zones have different sizes of capacitive patches.

In a further embodiment of the antenna array, the inductive rectangular wire loops of the plurality of TDU cells are in contact with the inductive rectangular wire loops of adjacent TDU cells.

In a further embodiment of the antenna array, the plurality of TDU cells provide a down-tilt angle for radio frequency (RF) beams from the radiating elements.

In a further embodiment of the antenna array, the antenna array assembly is an orthogonal-beam-space (OBS) massive multiple-input-multiple-output (MIMO) array assembly.

BRIEF DESCRIPTION OF THE DRAWINGS

Embodiments are described herein with reference to the appended drawings, in which.

DETAILED DESCRIPTION

An antenna array assembly is described that can produce multiple narrow beams using a metamaterial-based lens, or transmitarray, arranged next to an array of antenna elements. The transmitarray comprises a plurality of sub-wavelength true-time-delay unit cells formed from a metamaterial. Each of the metamaterial time-delay unit cells of the transmitarray is designed to provide a desired time-delay and phase shift at each particular transmitarray aperture location. A broadband beam collimation device can be formed using these metamaterial-based time-delay units. The metamaterial-based time delay units described herein can be used to produce a low-profile transmitarray with broader frequency bandwidth as compared to previous metamaterial-based attempts which were limited to transmitarrays having relatively small time-delay variations. The small-time delay variations of previous transmitarrays resulted in large antenna assembly profiles and/or antenna assemblies that were limited to a narrow frequency band. The antenna array assembly described herein may be used in an orthogonal beam space (OBS) multi-user (MU) multiple-input-multiple-output (MIMO) system or in other systems where producing a plurality of orthogonal beams is desirable.

True-time-delay metamaterial non-resonant constituting elements may be exploited for development of low-profile, band-pass frequency-selective surfaces (FSS) and microwave lenses, in place of the traditional resonant antennas. Such non-resonant periodic structures can be used to design ultra-thin and low-profile band-pass frequency-selective-surface (FSS) or lens antennas. The non-resonant elements typically consist of multiple layers of patches and grids of wire crosses in sub-wavelength periodicities. Each of these elements can be designed to emulate an Nth-order band-pass or low-pass filter response with proper time delay and transmission phase over a limited frequency band. However, previous time-delay unit cells can only produce a microwave lens using a single size of time-delay unit arranged in a rectangular grid with a relatively small range of total time-delay variations between the units. As a result, the use of such time-delay unit cells has been limited to antenna assemblies with a relatively large spacing between feed antennas and the lens aperture, or low profile antennas having a narrow frequency bandwidth.

The antenna array assembly described herein uses a metamaterial based transmitarray, or microwave lens, that uses a perimeter wire loop for each constituent delay unit cell in the structure of the metamaterial. The wire loop allows different sized time delay units to be used within the transmitarray. The use of varying sizes of TDUs provides a larger possible variation in time delay, and as such may be used in low profile designs that operate over a relatively large frequency range.

Figure 1A:
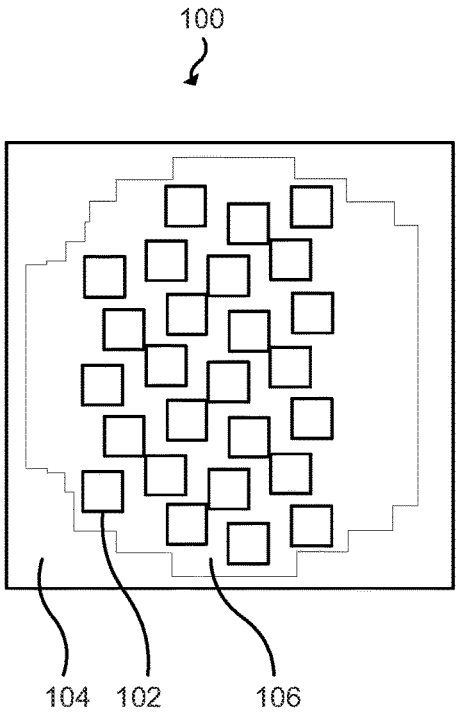
FIGS. 1A, 1B depict a multi-beam antenna array assembly.
Figure 1B:
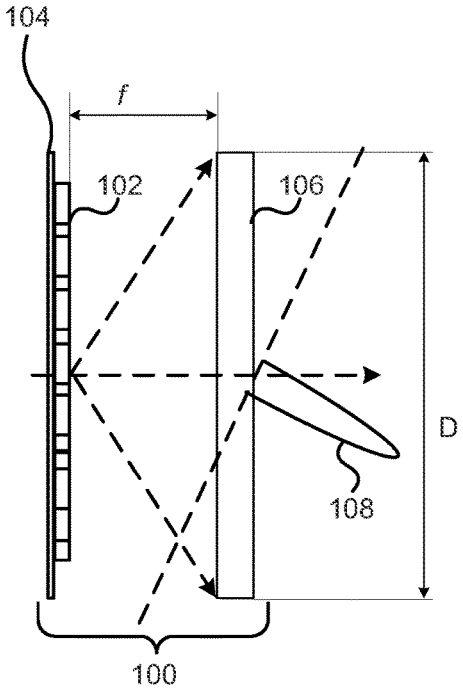

FIG. 1A depicts a top view of a multi-beam antenna array assembly 100. FIG. 1B depicts a side view of the multi-beam antenna array assembly 100 of FIG. 1A. The antenna array assembly 100 may be used in various communication systems, including for example an OBS MU-MIMO system. As depicted, the antenna array assembly 100 comprises a plurality of feed antennas 102 arranged in an array that is distributed on a reflector or other supporting structure 104. A transmitarray, or metamaterial RF lens, 106 acts as a microwave lens and is located a focal length f away from the feed antennas 102. The transmitarray 106 has an aperture dimension, D. The transmitarray 106 is a low-profile quasi-periodic planar surface that is constructed from metamaterial-based multi-layered components. The transmitarray 106 may be formed using printed circuit technologies or other fabrication processes.

The feed antennas 102 of the antenna array assembly 100 may be distributed on the supporting structure 104 in a focal plane located at a perpendicular distance, f, from the transmitarray 106 surface. In FIG. 1A, radiating elements of the feed antennas 102 are depicted as low-profile patches; however, any other radiating element with appropriate radiation patterns for the desired application may also be used.

The transmitarray 106 is designed to transform incident radiated waves from each feed antenna 102 to produce respective narrow beams with a unique beam pointing angle, depicted as downward pointed beam 108, corresponding to the particular position of the feed antenna within the focal plane. Communication techniques, such as OBS MU-MIMO, may benefit from the antenna array assembly 100, which is capable of producing a set of orthogonal beams with minimum beam-coupling-factor (BCF) among all beams. To minimize BCF among beams, radiating elements of the feed antennas 102 may be distributed on the focal plane with appropriate spacing along orthogonal axes between the radiating elements of the feed antennas 102, as depicted schematically in FIG. 1B. Such an arrangement of the feed antennas 102 may reduce overlap among beams due to offset in beam pointing angle from the transmitarray 106 between neighboring beams.

Figure 2A:
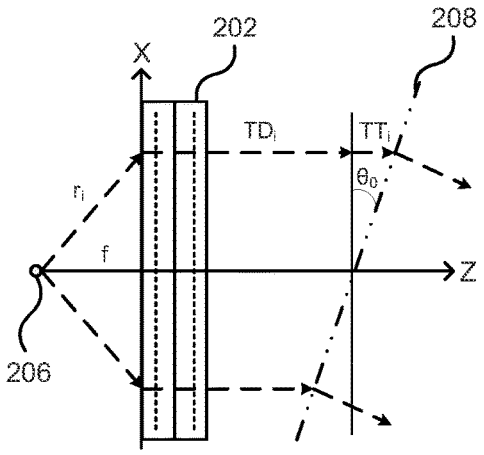
FIGS. 2A, 2B depict details of a transmitarray for a multi-beam antenna array assembly.
Figure 2B:
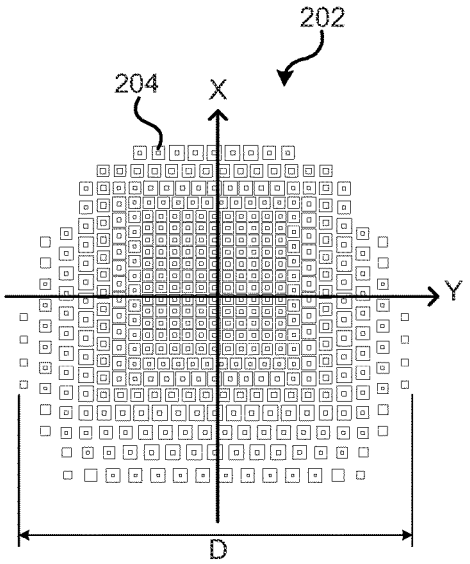

FIG. 2A depicts details of a transmitarray for a multi-beam antenna array assembly in a side view. FIG. 2B depicts a top view of the transmitarray 202 of FIG. 2A. The top view of FIG. 2B depicts a plurality of individual TDU cells 204, or more particularly capacitive patches of TDU cells, forming the transmitarray 202. Generally, for base-station antenna applications, it is desirable to configure the time-delay profile and phase shift characteristics of the transmitarray 202 such that all signals radiated from a focal point 206 end at a down-tilted plane 208 with the same electrical path length and a constant phase shift for all frequencies of operation. These conditions can be described by the following equations:

Time delay:

$$TD(x_i, y_i) = TD_i + TT_i = \frac{1}{c} \cdot \left( \sqrt{\left(\frac{D}{2}\right)^2 + f^2 - r_i} + x_i \cdot \tan(\theta_o) \right) + TD_o \quad (1)$$

Phase Shift:

$$\Phi(x_i, y_i) = \frac{2\pi}{\lambda} \cdot \sqrt{\left(\frac{D}{2}\right)^2 + f^2 - r_i} + x_i \cdot \tan(\theta_o) + \Phi_0 \quad (2)$$

Because each of the TDU cells 204 has an inherently limited frequency bandwidth, a metamaterial transmitarray 202 satisfying both equations (1) and (2) mitigates chromatic aberrations in the transmitarray 202 due to frequency dependent phase shift. Using a metamaterial with perimeter wire loops described below allows distribution of TDU cells 204 in an irregular grid pattern. The irregular grid pattern allows different sizes of TDU cells 204 to be used while maintaining current continuity between adjacent TDU cells. The ability to vary the sizes of TDU cells can significantly improve the achievable total time-delay variations of the transmitarray 202. Such total time-delay variation allows design of an RF transmitarray 202 with a smaller f/D ratio, resulting in a smaller possible antenna profile, or a transmitarray 202 with a broader possible frequency bandwidth.

Figure 3:
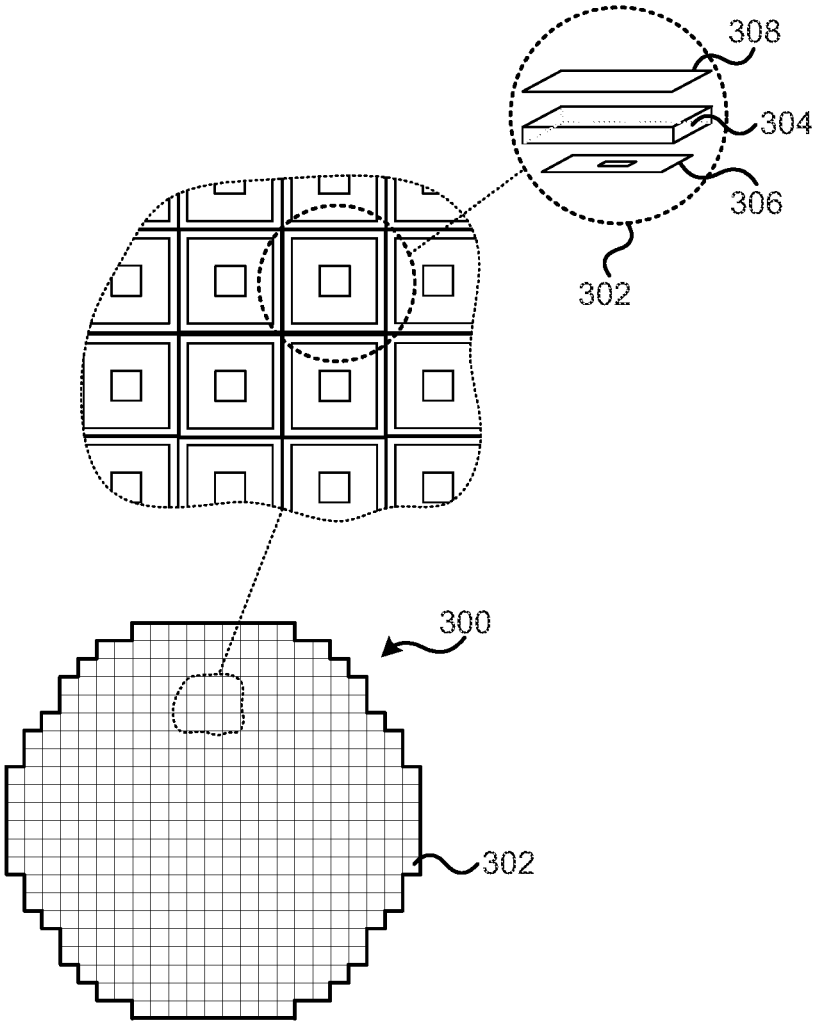
FIG. 3 depicts a transmitarray and details of a time delay unit (TDU) cell.

FIG. 3 depicts a transmitarray and details of a time delay unit (TDU) cell. As depicted, the transmitarray 300 comprises a plurality of adjacent TDU cells 302. Each of the TDU cells 302 comprises a dielectric material 304 with a capacitive patch 306 on a first side of the dielectric material 304. An inductive rectangular wire loop 308 is located on a second side of the dielectric material 304. The rectangular wire loop 308 is arranged about a perimeter of each of the TDU cells 302 so that wire loops of adjacent TDU cells are in contact with each other to provide current continuity between adjacent TDU cells. The TDU cells 302 depicted in FIG. 3 are all the same size. However, as described further below, it is possible for the transmitarray 300 to have different sized TDU cells. Because the rectangular wire loop is located about the perimeter of the TDU cells, even when different sized TDU cells are used, the wire loops of adjacent TDU cells remain in contact with each other.

Figure 4A:
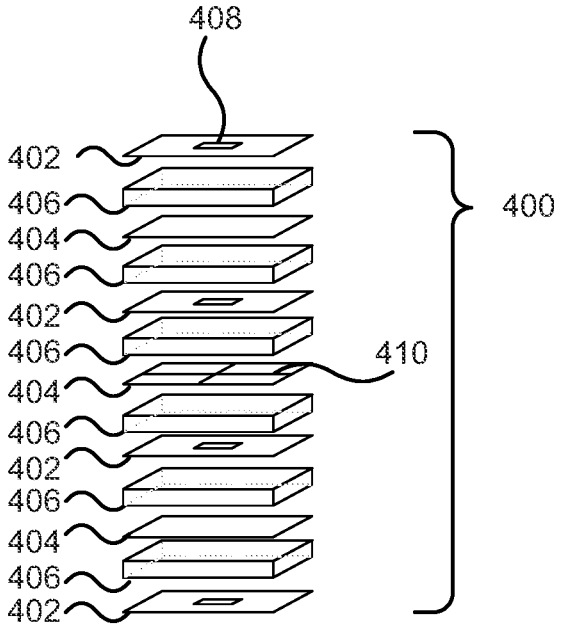
FIG. 4A depicts a further structure of a TDU cell used in a transmitarray.

FIG. 4A depicts details of the distributed time-delay unit (TDU) cell. As described above, a transmitarray may be formed as a plurality of adjacent individual TDUs. Each TDU cell 400 is similar to the TDU cell 302 described above. However, in contrast to the TDU cells 302, which each have a single rectangular wire layer and a single capacitive patch layer separated by a dielectric material, the TDU cell 400 comprises a plurality of capacitive patch layers 402, and a plurality of inductive wire loop layers 404 with separating layers of dielectric material 406 between each of the capacitive and inductive layers 402, 404. Each capacitive patch 402 may comprise a rectangular patch of a particular size. Further, each capacitive patch 402 may have an inductive cut-out 408 in the center although the cutout may be omitted.

The inductive wire grid layers 404 each comprise a rectangular wire loop arranged along the edges, or perimeter of the TDU cell. Accordingly, wire loops of corresponding layers in adjacent TDU cells will be in contact with each other and provide current continuity between the adjacent TDU cells. Additionally, the inductive wire loop may include a wire connecting cross 410 in the middle of the wire loop. Because the wire loop is along the edges of a TDU cell instead of in the center of the cell, electric current continuity between all TDU cells is enforced, regardless of the size and position of neighboring TDU cells. As a result of this geometry, the metamaterial of the TDU cells allows the use of TDU cells having different sizes as well as using an irregular grid of TDUs because the wire grid of TDUs no longer needs to be of the same size to enforce the current continuity between TDU cells. This may significantly improve the total time-delay variations across the transmitarray compared to previous metamaterial geometry which required the use of a constant TDU cell dimension.

Figure 4B:
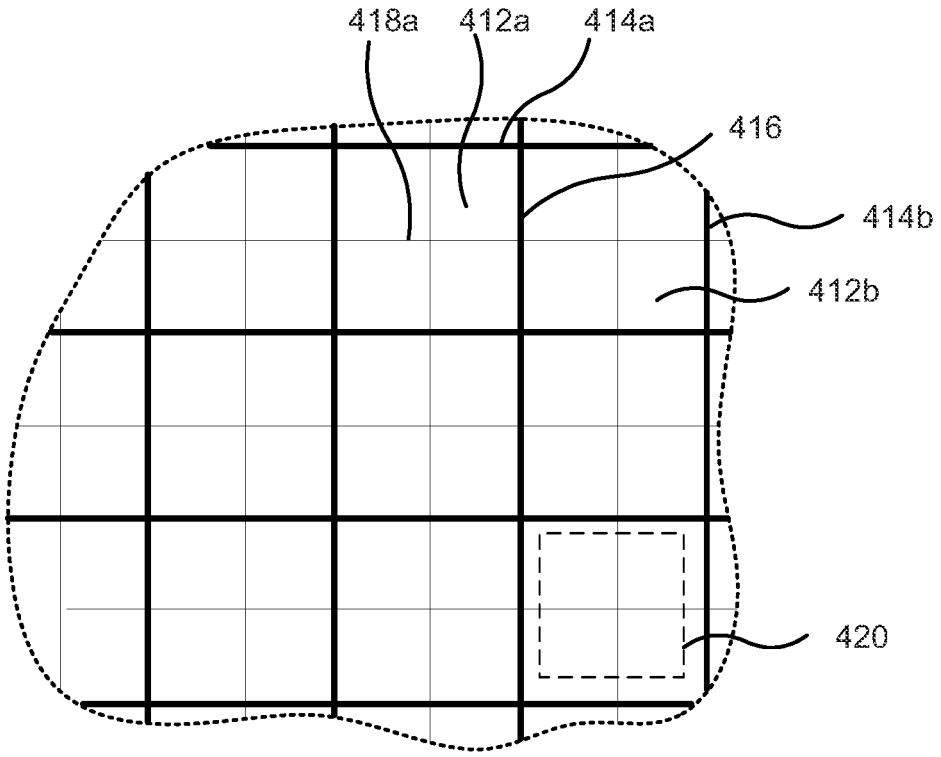
FIG. 4B depicts details of a rectangular wire grid with crosses.

FIG. 4B depicts details of a rectangular wire grid with crosses. A plurality of TDU cells are depicted, two of which are labeled as 412*a*, 412*b*. A plurality of individual rectangular wire loops, two of which are labeled as 414*a*, 414*b*, define the boundary of each of the TDU cells 412*a*, 412*b*. As depicted, the rectangular wire loops 414*a*, 414*b* are in contact with adjacent wire loops through a common wire section 416. In addition to the wire grid formed from the plurality of wire loops in contact with each other, the wire grid may include wire crosses 418*a* within each of the rectangular wire loops of the grid. Although depicted as being provided within each of the rectangular wire loops, the crosses may be located in less than all of the rectangular wire loops. A location of a capacitive patch in one of the TDU cells is depicted as a dashed line rectangle 420.

Figure 5A:
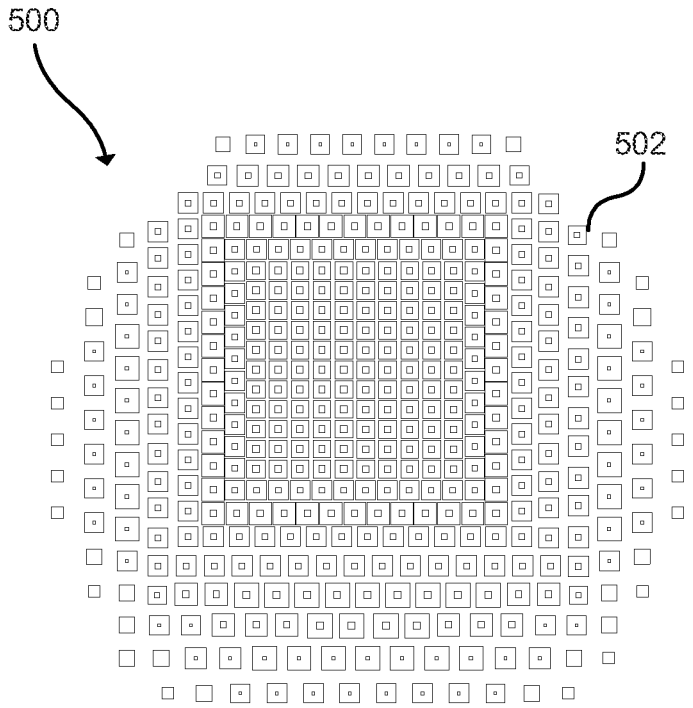
FIG. 5A depicts a capacitive patch layer used in a transmitarray.
Figure 5B:
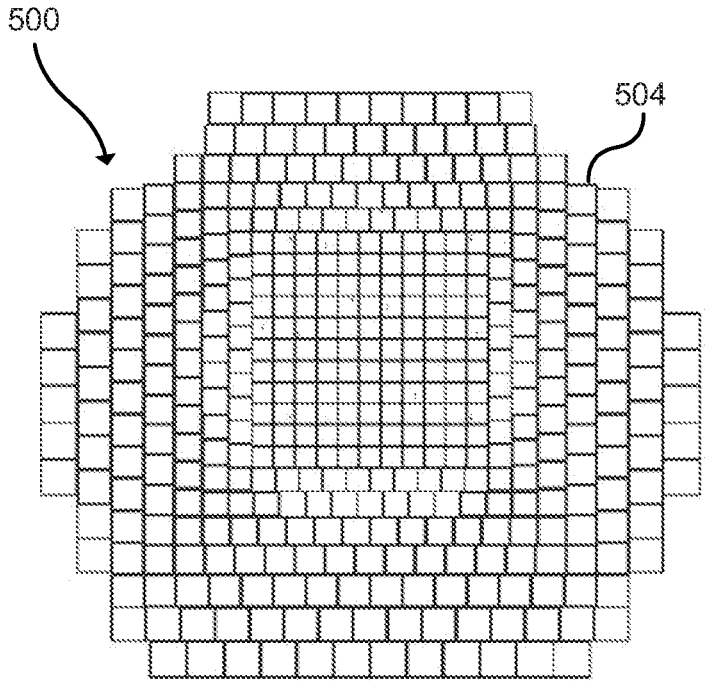
FIG. 5B depicts an inductive wire loop layer used in a transmitarray.

FIG. 5A depicts a capacitive patch layer used in a transmitarray. FIG. 5B depicts an inductive wire loop layer used in a transmitarray. The transmitarray 500 may comprise a plurality of capacitive patch layers 502 and inductive wire loop layers 504 as described above. Although described above as individual TDU cells, the plurality of TDU cells of the transmitarray 500 may be formed together in layers. As depicted, a patch layer 502 may be formed on a first side of a substrate (not depicted in FIGS. 5A and 5B). An inductive wire loop layer 504 may be formed on a second side, opposite the first side, of the substrate. If multiple rectangular wire loop layers 504 and/or capacitive patch layers 502 are used in the transmitarray 500, the process may repeated until the entire layered structure of all the TDUs of the transmitarray is formed.

Figure 6:
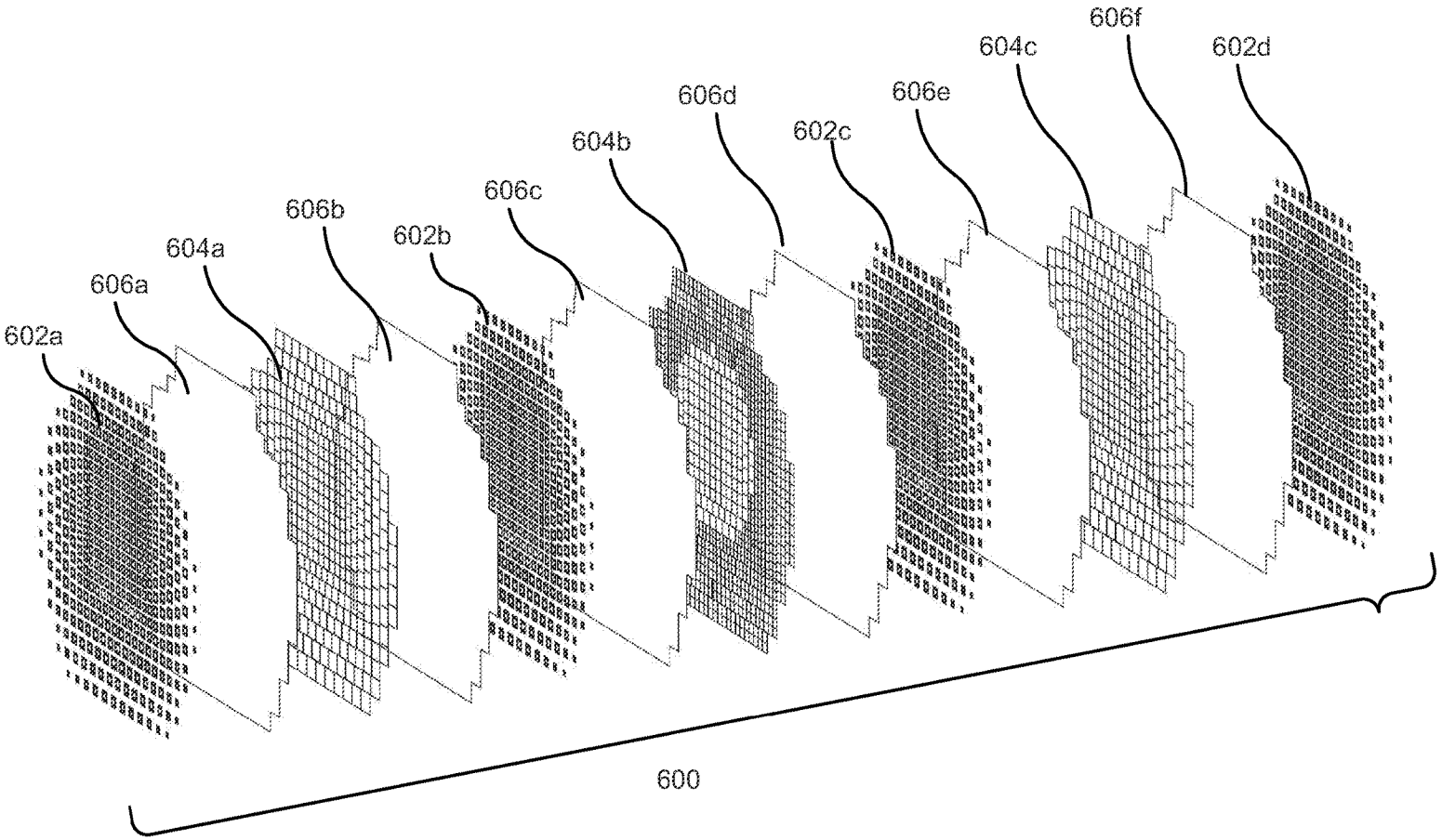
FIG. 6 depicts a layered structure of a transmitarray.
Figure 7:
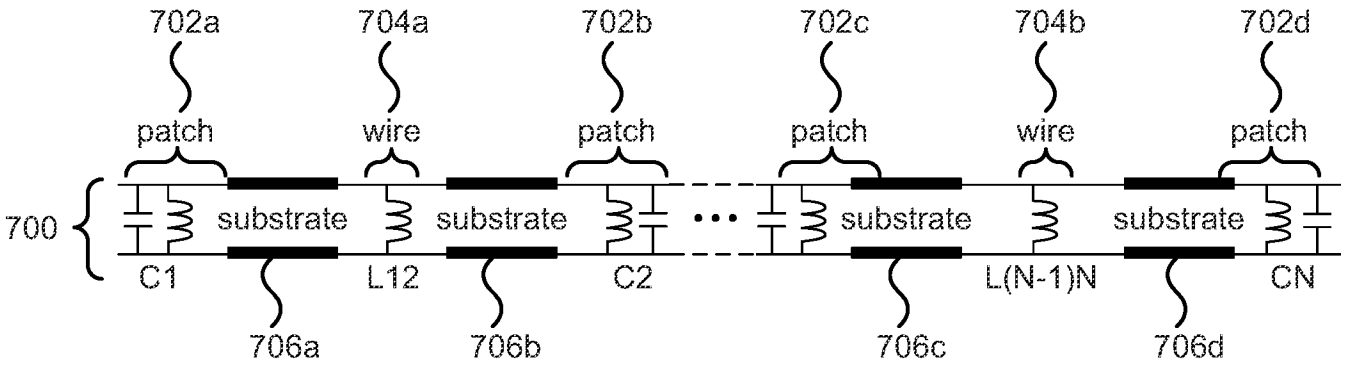
FIG. 7 depicts an equivalent circuit representation of a TDU cell.

FIG. 6 depicts a 3D exploded view of individual layers of a transmitarray. As depicted, the plurality of adjacently arranged time-delay unit (TDUs) cells are formed as a plurality layers of capacitive patches and inductive wire loops separated by dielectric material. In particular, the transmitarray 600 comprises 4 capacitive patch layers 602*a*, 602*b*, 602*c*, 602*d* (referred to collectively as capacitive patch layers 602), and 3 wire loop layers 604*a*, 604*b*, 604*c* (referred to collectively as wire loop layers 604). Each capacitive patch layer 602 is separated from adjacent wire loop layers 604 by a dielectric material layer 606*a*, 606*b*, 606*c*, 606*d*, 606*e*, 606*f* (referred to collectively as dielectric layers 606).

The capacitive patch sizes of TDU cells of a particular layer may vary within the bounds of the TDU cell size. Additionally, the capacitive patch sizes of the different capacitive patch layers of a particular TDU cell may vary. Similarly, the cut-out size of capacitive patches may vary across different TDU cells as well as between different capacitive patch layers of a single TDU cell. Although each wire loop structure of each wire loop layer of each TDU cell includes a wire loop arranged about edges of the TDU cell so that the wire loops of adjacent TDU cells on the same wire loop layer are in contact with each other, they may optionally include internal wire crosses in order to vary the electrical characteristics of the individual TDU cells. Although it is preferable for all of the TDU cells to include wire crosses in a particular layer (e.g., layer 604*b*), it is possible for only some of the TDU cells to have internal wire crosses in a particular layer. Both wire loop layers 604*a* and 604*c* are depicted without crosses, and wire loop layer 604*b* includes wire crosses within the wire loop of each TDU. In addition to the inclusion of wire crosses within the rectangular wire loops, it is possible to vary the electrical characteristics by changing a thickness of the wire used in the wire loop layer, as well as varying the conductive material used for the wire.

The transmitarray 600 is formed as a relatively thin multi-layered printed circuit structure comprising alternating layers of distributed quasi-periodic sub-wavelength capacitive patch layers 602 and inductive wire grid layers 604, separated by a thin layer, or layers, of insulating dielectric material. The wire loop layers 604 are generally in the form of 2D non-periodic structure to allow for wider time-delay distribution. That is, the rectangular wire loops allows different sizes of TDU cells to be used together in a non-periodic structure.

The structure of the individual TDU cells described above having alternating layers of capacitive patches and inductive wire loops can be modeled as a cascaded series of LC resonators.

Figure 8:
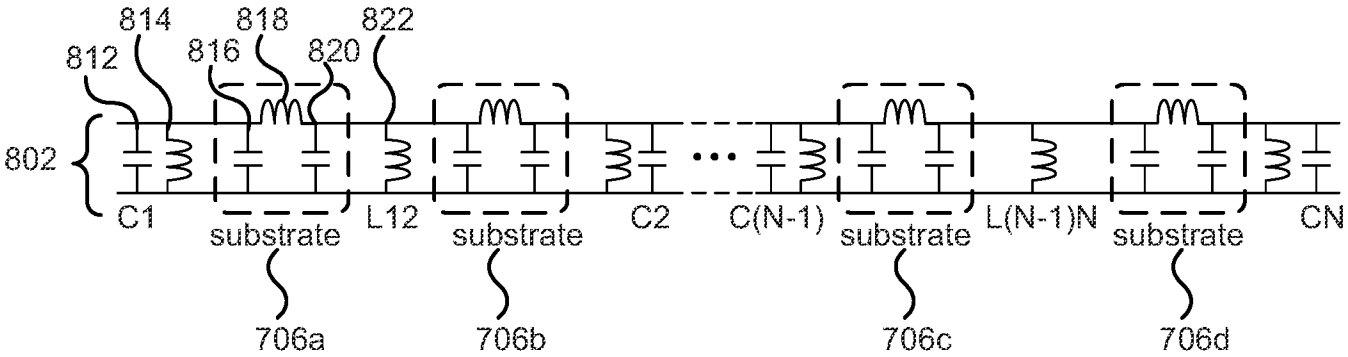
FIG. 8 depicts an equivalent circuit representation of a TDU cell.
Figure 9:
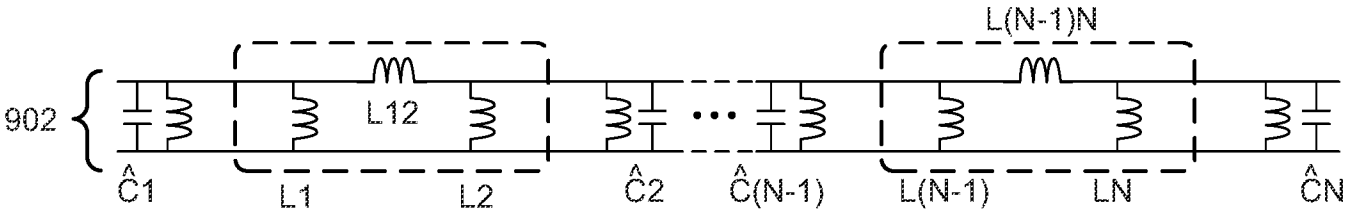
FIG. 9 depicts an equivalent circuit representation of a TDU cell.
Figure 10:
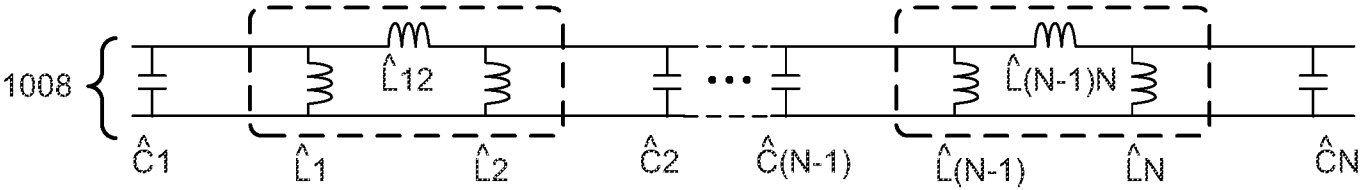
FIG. 10 depicts an equivalent circuit representation of a TDU cell.
Figure 11:
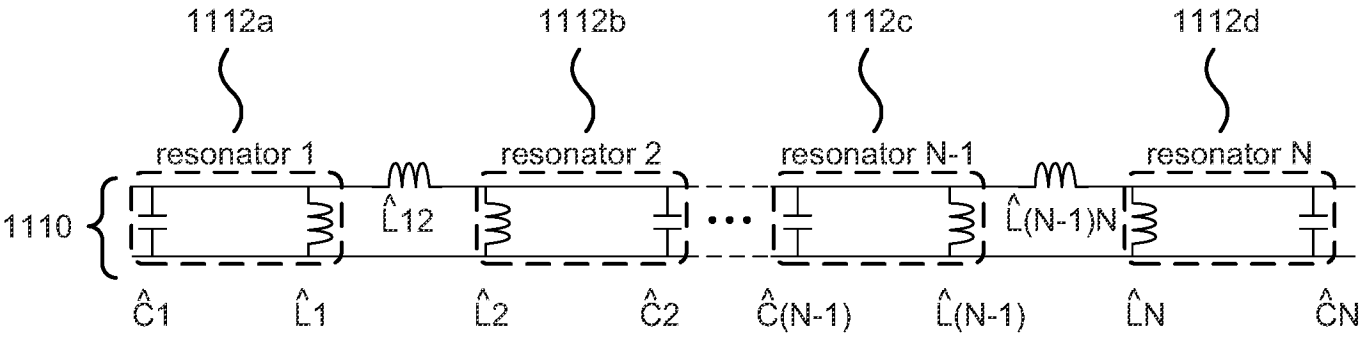
FIG. 11 depicts equivalent circuit representations of a TDU cell.

FIGS. 7-11 depict equivalent circuit representations of a TDU cell. A TDU cell 700 with N layers of capacitive patches 702*a*-702*d* and (N−1) layers of wire loops 704*a*-704*b* can form N resonators and therefore can emulate an Nth order band pass filter response. An equivalent circuit 802 of the spatial time-delay metamaterial TDU cell at normal incidence is depicted in FIG. 8. Each of the capacitive patches and cutouts 702*a*-702*d* acts as a capacitor 812 in parallel with a shunt inductor 814. Each of the wire loops 704*a*-704*b* acts as a respective inductor 822. By varying the size of the capacitive patch and associated cutout, the characteristics of the circuit 802 can be tuned. Equivalent circuit 802 depicts the TDU cell 700 with a transmission line model. As depicted, each dielectric substrate material can be modeled as a pair of capacitors 816, 820 separated by an inductor 816. The equivalent circuit 802 can be further simplified to the transmission line model equivalent circuits 902 and 1002 depicted in FIGS. 9 and 10 respectively by combining parallel parasitic capacitances and performing a T to pi circuit transformation for the inductances. Equivalent circuit 1102 of FIG. 11 depicts the equivalent circuit 1002 in a filter resonator representation. As depicted, the TDU cell provides N resonators 1112*a*-1112*d*.

The rectangular cut-out in the center of a capacitive patch represents a shunt inductor in parallel with the shunt capacitor of the patch. As a result, the resonant frequency of a TDU can be shifted up or down easily by simply changing the physical size of the rectangular cut-out. Physical geometry parameters of the TDU can be extracted using various known procedures. Once the physical geometry parameters are determined, the properties of each TDU cell can be designed to provide the time delay, phase and frequency response as required depending on the aperture location of the TDU cell, by using a standard filter design formula. The determined properties for a TDU cell may include, for example, a size of the capacitive patch for each capacitive layer, a size of the cut-out of the capacitive patch of each capacitive layer, a size of the wire of each wire loop layer, a presence of a wire connecting cross in each wire loop layer as well as a thickness of the dielectric material.

The physical dimension of a TDU cell, Cd, is first predetermined and fixed at a particular value. Then, the sizes of the capacitive patches, cut-outs, and wires are chosen to provide the required phase and time-delay characteristics. Although changes in the phase and time delay also change the center frequency of operation of the TDU cell, such a procedure works for a small range of time-delay variation. As changes in time delay and phase variation get larger, frequency shift in the TDU cell eventually moves the frequency of operation of the TDU cell out of the operating frequency band of interest. As a result, this limits the overall achievable time-delay variations of the lens. However, unlike previous approaches, the current TDU cell geometry allows an additional degree of freedom in the design by allowing the change in dimensions of a TDU cell at any location without disrupting electric current continuity at the TDU cell boundaries. Increasing the size of a TDU cell as the radial dimension of the transmitarray increases provides a natural phase-shift and time-delay reduction without affecting the center frequency of operation of the TDU cell. As a result, it is possible to achieve a larger time-delay and phase shift.

The metamaterial transmitarray can be designed by separating the entire surface into several discrete regions, or zones. Because each TDU has a rectangular shape, the entire transmitarray, or lens, may be divided into M rectangular zones. TDU cells in each of these zones have a same cell size Cd, which can be different from the cell size in other zones. Cell size selection is such that an outer zone has a larger cell size than that of an inner zone to achieve a larger overall frequency bandwidth. Although the cell size of each zone is the same, the capacitive patch, and inductive cut-out of the patch, of TDU cells within the same zone may vary.

Figure 12:
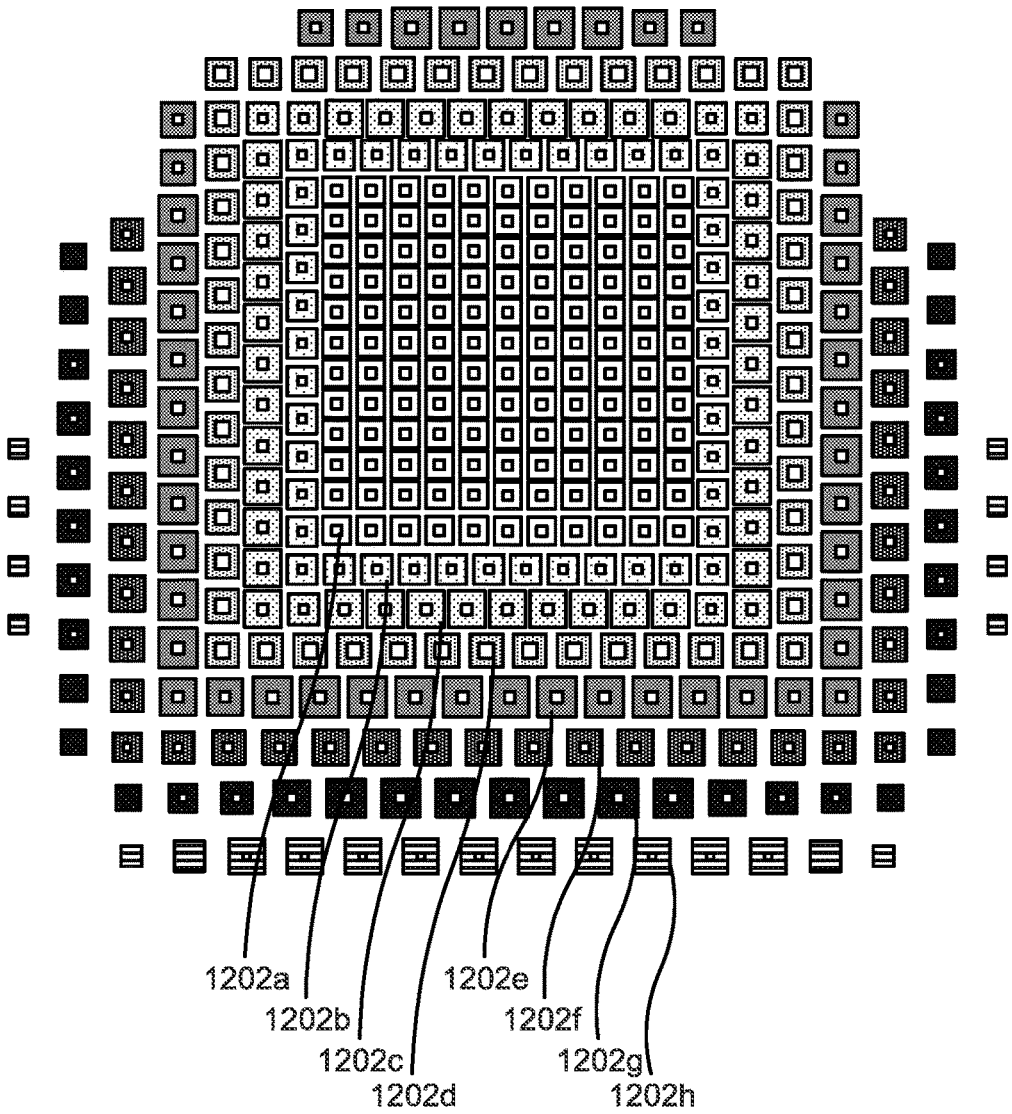
FIG. 12 depicts TDU cells of different sizes arranged in zones.

FIG. 12 depicts capacitive patches of a transmitarray having different sized TDU cells. A transmitarray may group TDUs into a plurality of zones 1202*a*-*h* (referred to collectively as zones 1202). It is noted that FIG. 12 depicts a capacitive patch of each TDU cell; the wire loops at the perimeter of each TDU cell are not visible. Each of the zones 1202 comprises a number of TDU cells within a small range of time-delay variations. Design starts with a center zone 802*a*, which typically contains more TDU cells within a given range of time-delay as compared to other zones. All TDUs in this zone 802*a* have a same initial unit cell dimension ($Cd_{z1}$). After relative locations of the TDU cells are determined, time-delay and phase shift of each TDU cell can be designed according to equations (1) and (2). After the TDU cell design of the center zone is completed, the second zone 802*b* can be added with cell dimension ($Cd_{z2}$) slightly larger than that of the center zone 802*a*. However, for geometric continuity of the transmitarray, the dimensions of TDU cells in these two zones should be selected such that the following condition is met:

$$M \cdot Cd_{z1} = (N-2) \cdot Cd_{z2} \tag{3}$$

Where, $Cd_{z1}$ and $Cd_{z2}$ are cell sizes of the first zone 802*a* and second zone 802*b*, respectively; M is the number of TDU cells in the x or y direction of the first zone 802*a*, and N is the number of TDU cells in any linear direction of the second zone 802*b*. Typically, selection of a value N=M−1 is adequate. This process is repeated for each of the additional zones.

Figure 13:
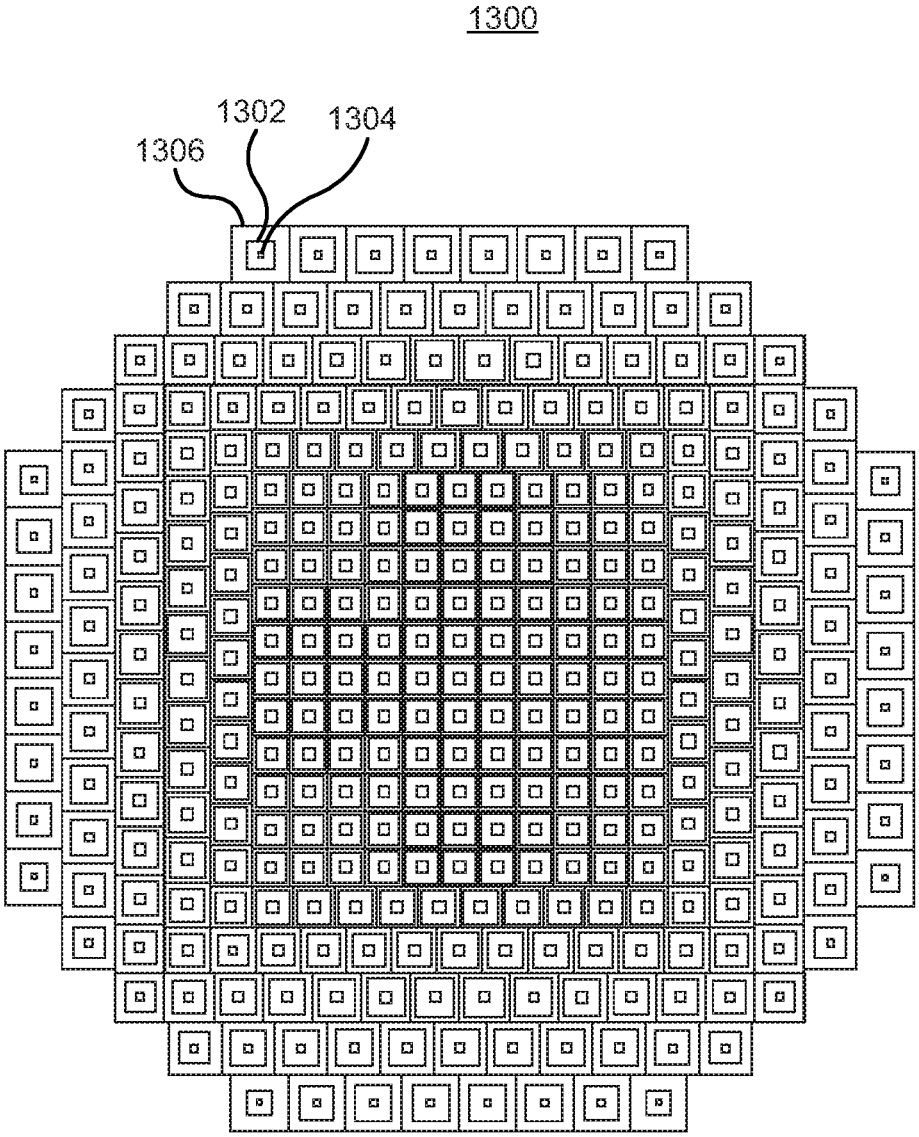
FIG. 13 depicts a transmitarray having no down-tilt of the phase front.

FIG. 13 depicts a transmitarray having no down-tilt of the phase front. As depicted in FIG. 13, the patch sizes 1302 and cut-out sizes 1304 of the TDU cells 1306 are vertically symmetric and as such, the transmitarray 1300 does not provide any tilt.

Figure 14:
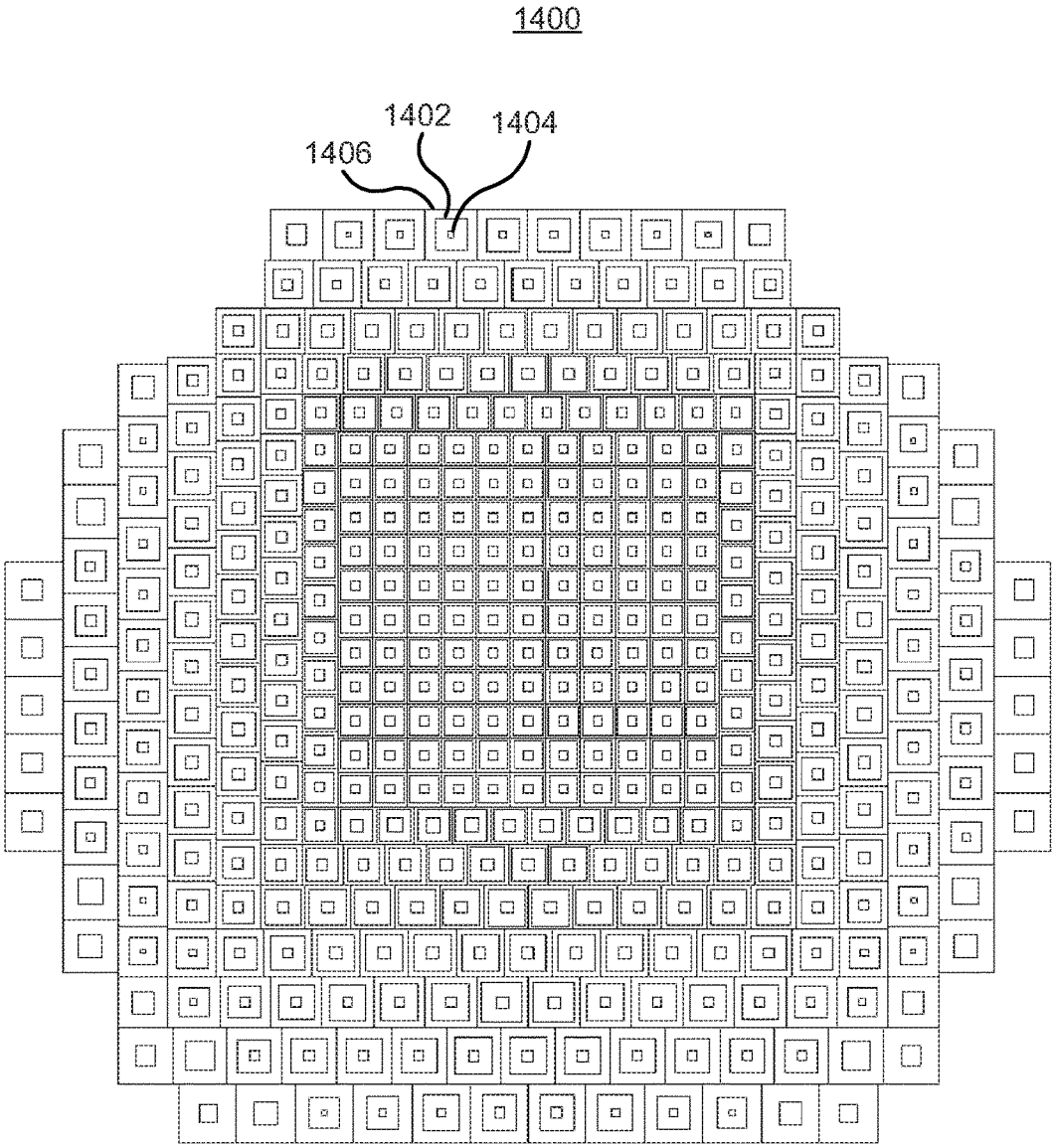
FIG. 14 depicts a transmitarray having 20° down-tilt of the phase front.

FIG. 14 depicts a transmitarray having 20° down-tilt of the phase front. As depicted in FIG. 14, the patch sizes 1402 and cut-out sizes 1404 of TDU cells 1406 are not vertically symmetric, and are arranged such that the transmitarray provides a 20° down-tilt of the phase front.

Figure 15:
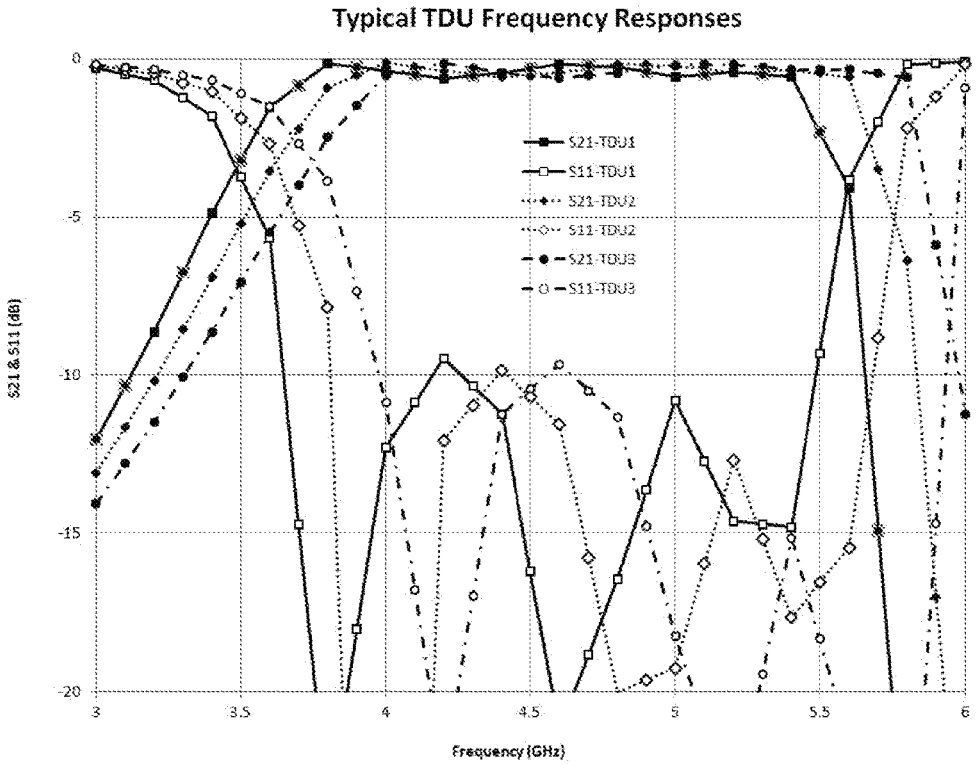
FIG. 15 depicts typical TDU frequency responses.
Figure 16:
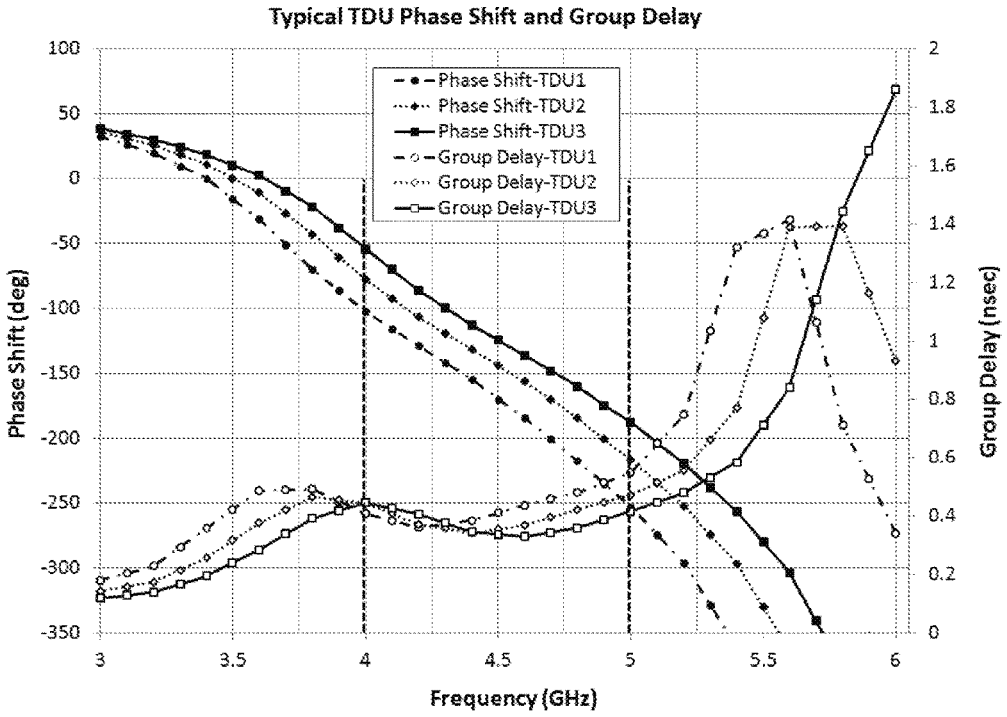
FIG. 16 depicts group delays and phase shifts of typical TDUs.

FIGS. 15 and 16 show frequency responses, phase shifts and group delays of some typical TDUs. In FIGS. 15 and 16, the typical TDU cells have time delay and phase shifts values that are within a range considered reasonable for practical implementations of TDU cells. The group delay values have relatively small variations, and phase shifts are linear within the frequency range of 4 GHz to 5 GHz.

Two metamaterial transmitarrays were designed and the performance simulated. These two transmitarrays were designed to operate in the frequency range of 4 GHz to 5 GHz with nominal down-tilt angles of 0° and 20°. The outside physical dimensions of the transmitarrays are 313 mm×351 mm for the down-tilt angle of 20° and 276 mm×276 mm for down-tilt angle of 0°. Transmitarray with 20° down-tilt has a total of 372 TDU cells, and the transmitarray without down-tilt has 341 TDU cells. Each TDU cell is a sub-wavelength TDU cell that is designed to give either $4^{th}$-order or $5^{th}$-order band-pass filter response operating in the 4 GHz to 5 GHz frequency range. The transmitarrays were designed with 8 zones, similar to the zones described with reference to FIG. 12. TDU cells in the center zone (Zone#1) were mostly of $5^{th}$-order units, which were made of 5 layers of capacitive patches and 4 layers of wire grids, with 8 layers of dielectric substrates. TDU cells in the outer zones were mostly $4^{th}$ order units which require only 4 layers of capacitive patches with 3 layers of wire grids and 6 layers of dielectric substrates. Materials used for the construction of the metamaterial TDU cells were Rogers 4003C hydrocarbon ceramic laminates. This material possesses good RF, mechanical and thermal properties and is available in various thicknesses. RO4003C 60 mil (1.524 mm) substrate was used for the top and bottom layer of the unit cell in both $4^{th}$-order and $5^{th}$-order TDU cells. Thin layers of 20 mil (0.508 mm) RO4003C were used in all the inner layers. A 4 mil (0.101 mm) layer of RO4450 bonding material was also included in the TDU cell model for bonding together of each substrate material. Total thicknesses of the TDU cells were 5.686 mm for $4^{th}$-order TDU cells and 8.936 mm for $5^{th}$-order TDU cells. After the TDU cell construction and thicknesses of the PCB material are determined, sizes of the patches and diameters of the wire grids of each TDU cell can be chosen to give the required time-delay and phase according to equations (1) and (2) above. The parameter setting process involves EM simulations using iterative full-wave simulator such as ANSYS HFSS®.

Feed antennas, provided by low profile patches, were distributed on a planar reflector located at 140 mm (f/D=0.4) away from the bottom surface of the TDU cells for the down-tilt=20° case, and at 120 mm (f/D=0.43) for the down-tilt=0° case. A total of M=8 zones were used for both transmitarrays with cell size dimension ranging from 11.5 mm at the center of the transmitarray to 19.55 mm at the outer edge of the transmitarray for down-tilt=20°. The TDU cell arrangement of the 20° down-tilt transmitarray is depicted in FIG. 14. For the transmitarray with the down-tilt angle of 0°, 6 zones of TDU cell sizes was used as shown in FIG. 13.

Tables 1 and 2 below provide cell sizes, time-delays and insertion phase characteristics of TDU cells for the two transmitarrays. For down-tilt=20°, TDU cell size increases slowly from 11.5 mm to 19.55 mm. This arrangement gives a total TDU cell time-delay and phase variations of 245 psec (105-350 psec) and 406° (+6/−400°). Similarly, for the down-tilt=0° transmitarray, the total time-delay and phase variation are 224 psec and 371°, respectively. Examples from previous RF lens design provided a total of 44 psec to 63 psec of time-delay, which required an f/D greater than 1. In contrast, a transmitarray according to the current teachings produces a lens with over 245 psec time-delay and with a f/D<0.45, which allows construction of a transmitarray with a much lower profile.

TABLE 1

Time delays and insertion phases of TDUs for 20° down-tilt transmitarray

| ZONE | CELL SIZE (MM) | NO. OF CELLS | TIME DELAY (PSEC) | PHASE (DEG) |
|---|---|---|---|---|
| 1 | 11.5 | 121 | (280-350) ± 3/181 | (−284/−400) ± 8 |
| 2 | 12.65 | 44 | (252-308) ± 3/120 | (−237/−330) ± 7 |
| 3 | 13.8 | 48 | (203-301) ± 3/164 | (−156/−318) ± 7 |
| 4 | 14.96 | 52 | (154-280) ± 3/134 | (−75/−284) ± 6 |
| 5 | 16.1 | 50 | (168-259) ± 3/161 | (−98/−249) ± 6 |
| 6 | 17.25 | 50 | (112-238) ± 3/165 | (−5/−214) ± 6 |
| 7 | 18.4 | 35 | (105-203) ± 3/187 | (6/−156) ± 10 |
| 8 | 19.55 | 22 | (105-175) ± 3/187 | (6/−110) ± 10 |

TABLE 2

Time delays and insertion phases of TDUs for 0° down-tilt transmitarray

| ZONE | CELL SIZE (MM) | NO. OF CELLS | TIME DELAY (PSEC) | PHASE (DEG) |
|---|---|---|---|---|
| 1 | 11.50 | 121 | (266-350) ± 3/181 | (−260/−400) ± 8 |
| 2 | 12.65 | 44 | (231-287) ± 3/60 | (−203/−295) ± 7 |
| 3 | 13.80 | 48 | (189-266) ± 3/69 | (−133/−260) ± 7 |
| 4 | 14.96 | 52 | (140-231) ± 3/78 | (−52/−203) ± 6 |
| 5 | 16.10 | 44 | (140-203) ± 3/66 | (−52/−156) ± 6 |
| 6 | 17.25 | 32 | (126-161) ± 3/122 | (−29/−87) ± 6 |

Figure 17:
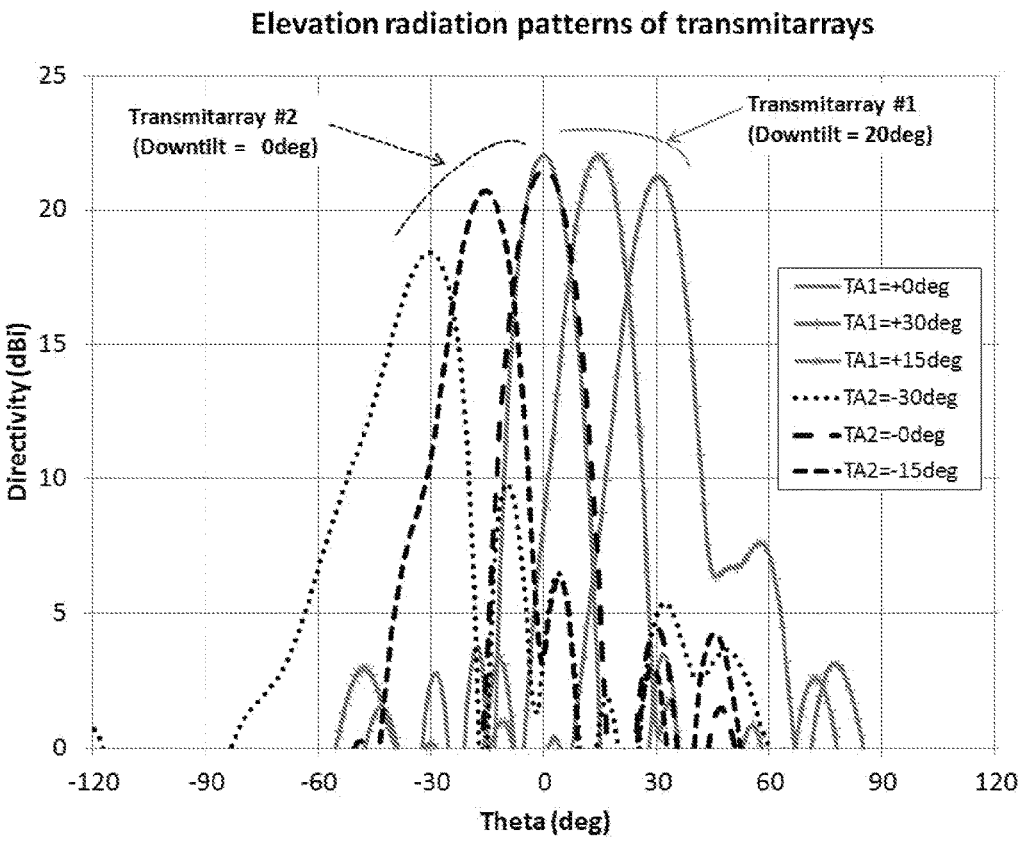
FIG. 17 depicts elevation radiation patterns of two transmitarrays.

FIG. 17 depicts radiation patterns of two transmitarrays. The down-tilt=20° case has a slightly higher directivity (22 dBi) compared to the transmitarray without any down-tilt (21.5 dBi). The directivity difference between the two transmitarray is even larger at higher scan angles: 21.2 dBi versus 18.4 dBi at scan angle of 30°. It is evident that gain drop over scan angles of a pre-tilt transmitarray is much slower than a regular lens. The BCF of these patterns is expected to be somewhat low to moderate, such as between −12 dB to −22 dB depending on the element spacing and array configuration. In general, an array with offset arrangement has a slightly lower BCF compared to a regular rectangular array.

Figure 18:
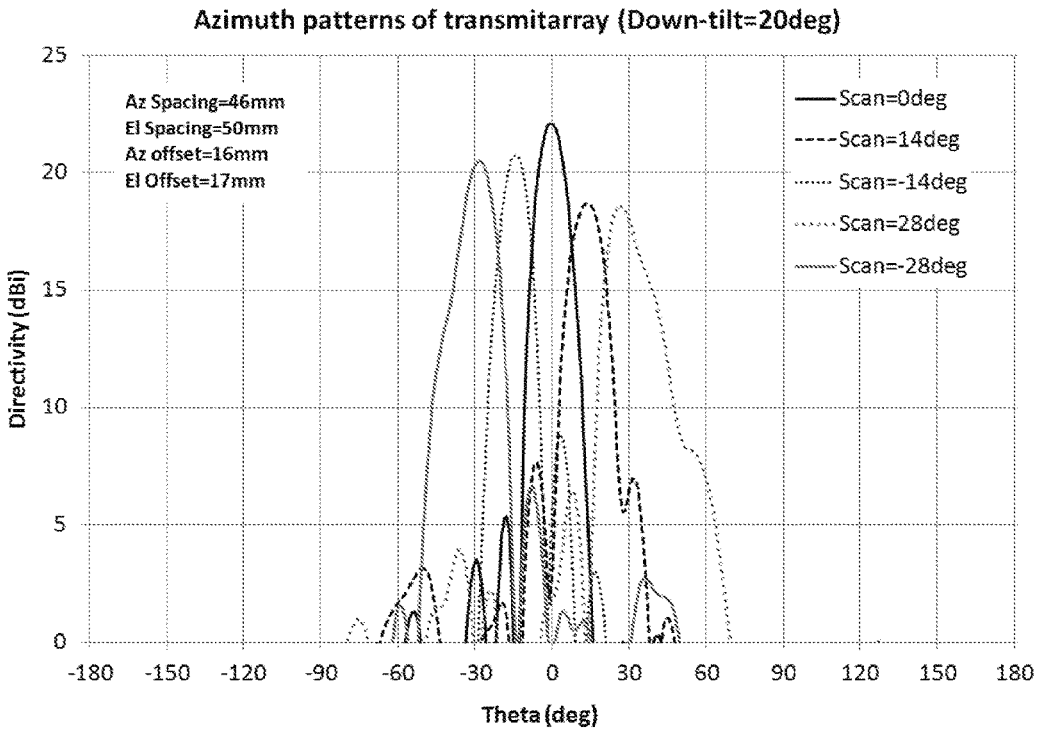
FIG. 18 depicts azimuth patterns of a transmitarray having 20° down-tilt of the phase front.

FIG. 18 depicts the azimuth radiation patterns of the transmitarray with down-tilt angle $\theta_o$=20°. In this case, beam-pointing-angle of each beam is slightly offset relative to each other due to offset of the feed antennas (Azimuth offset=16 mm, Elevation offset=17 mm). With this arrangement, BCF between any two neighboring beams is between −13 dB to −21.8 dB.

The above has described an antenna array assembly with particular reference to transmitting of signals. However, it will be appreciated that the same structure can be applied to reception of signals due to the reciprocal relationship of transmission and reception of signals.

The present disclosure provided, for the purposes of explanation, numerous specific embodiments, implementations, examples and details in order to provide a thorough understanding of the invention. It is apparent, however, that the embodiments may be practiced without all of the specific details or with an equivalent arrangement. In other instances, some well-known structures and devices are shown in block diagram form, or omitted, in order to avoid unnecessarily obscuring the embodiments of the invention. The description should in no way be limited to the illustrative implementations, drawings, and techniques illustrated, including the exemplary designs and implementations illustrated and described herein, but may be modified within the scope of the appended claims along with their full scope of equivalents.

Although several embodiments have been provided in the present disclosure, it should be understood that the disclosed systems and components might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

What is claimed is:

1. A metamaterial lens for a radio frequency (RF) antenna comprising a plurality of adjacent time-delay unit (TDU) cells, each TDU cell comprising:

a dielectric material;

an inductive rectangular wire loop on a first side of the dielectric material arranged about a perimeter of the TDU cell; and a capacitive patch on a second side of the dielectric material and positioned within the perimeter of the TDU cell.

2. The metamaterial lens of claim 1, wherein the plurality of TDU cells comprise a plurality of subsets of TDU cells, wherein the TDU cells of different subsets are of different sizes and the TDU cells within the same subset are of the same size.

3. The metamaterial lens of claim 1, wherein a plurality of subsets of the plurality of different-sized TDU cells are arranged into a plurality of zones grouping together subsets of TDU cells of the same size with a smallest TDU cell located at an interior first zone with increasingly sized TDU cells surrounding zones of smaller sized TDU cells.

4. The metamaterial lens of claim 3, wherein TDU cells within the same subset of TDU cells have different sizes of capacitive patches.

5. The metamaterial lens of claim 1, wherein the inductive rectangular wire loops of the plurality of TDU cells are in contact with the inductive rectangular wire loops of adjacent TDU cells.

6. The metamaterial lens of claim 1, wherein at least one of the plurality of TDU cells includes an inductive wire cross within the inductive wire loop.

7. The metamaterial lens of claim 1, wherein the capacitive patches of at least a subset of the TDU cells have different patch sizes.

8. The metamaterial lens of claim 1, wherein one or more of the capacitive patches of the plurality of TDU cells have an inductive cut-out.

9. The metamaterial lens of claim 1, wherein each of the plurality of TDU cells comprises one or more additional layers of inductive rectangular wire loops located along the perimeter of the TDU cell.

10. The metamaterial lens of claim 1, wherein each of the plurality of TDU cells comprises a plurality of layers of capacitive patches.

11. The metamaterial lens of claim 1, wherein each of the TDU cells comprises a plurality of layers of inductive rectangular wire loops located along a perimeter of the TDU cell and a plurality of layers of capacitive patches, each of the layers separated by a dielectric material.

12. An antenna array assembly comprising:

a transmitarray having a focal distance, the transmitarray having a plurality of adjacent time-delay unit (TDU) cells, each TDU cell having an inductive rectangular wire loop located along a perimeter of the TDU cell, a capacitive patch, and a dielectric material separating the inductive rectangular wire loop and the capacitive patch; and a plurality of radiating elements arranged at a focal plane located the focal distance from the transmit array.

13. The antenna array assembly of claim 12, wherein the plurality of TDU cells comprise a plurality of subsets of TDU cells with the TDU cells of different subsets are of different sizes, while TDU cells within the same subset are of the same size.

14. The antenna array assembly of claim 13, wherein the subsets of the plurality of different-sized TDU cells are arranged into a plurality of zones grouping together subsets of TDU cells of the same size with a smallest TDU cell located at an interior first zone with increasingly sized TDU cells surrounding zones of smaller sized TDU cells.

15. The antenna array assembly of claim 14, wherein TDU cells within respective ones of the plurality of zones have different sizes of capacitive patches.

16. The antenna array assembly of claim 12, wherein the inductive rectangular wire loops of the plurality of TDU cells are in contact with the inductive rectangular wire loops of adjacent TDU cells.

17. The antenna array assembly of claim 12, wherein the plurality of TDU cells provide a down-tilt angle for radio frequency (RF) beams from the radiating elements.

18. The antenna array assembly of claim 17, wherein the antenna array assembly is an orthogonal-beam-space (OBS) massive multiple-input-multiple-output (MIMO) array assembly.

* * * * *